United States Patent [19]

Matsuo

[11] 4,031,816

[45] June 28, 1977

[54] APPARATUS FOR TRIMMING ADHERING SCRAP FROM A PUNCHED CARDBOARD BLANK

[76] Inventor: Masaharu Matsuo, No. 3-17, 3-Chome, Higashi Komagata, Sumida,Tokyo, Japan

[22] Filed: May 19, 1976

[21] Appl. No.: 687,687

[30] Foreign Application Priority Data

July 14, 1975 Japan ..... 50-85339

[52] U.S. Cl. ..... 93/36 A; 83/103; 93/59 ES

[51] Int. Cl.[2] ..... B26F 3/02

[58] Field of Search ..... 83/103; 93/36 A, 59 ES; 225/97; 198/626, 885, 842

[56] References Cited

UNITED STATES PATENTS

| | | | |
|---|---|---|---|
| 475,246 | 5/1892 | Morton | 93/36 A |
| 842,611 | 1/1907 | Bell | 198/835 X |
| 3,235,149 | 2/1966 | Armstrong, Jr. et al. | 93/36 A X |
| 3,524,364 | 8/1970 | Bishop | 93/36 A X |
| 3,887,063 | 6/1975 | Villanueva et al. | 198/626 |
| 3,956,974 | 5/1976 | Schroter | 93/36 A |
| 3,964,655 | 6/1976 | Kotaro | 225/97 |

*Primary Examiner*—Joseph H. McGlynn
*Assistant Examiner*—Paul A. Bell
*Attorney, Agent, or Firm*—Hans Berman

[57] ABSTRACT

Adhering scrap is trimmed from a punched cardboard blank by apparatus in which driven surface portions of two conveyors in a common plane define successive, spaced-apart parts of a path of travel for the blank. A roller rotatable between the conveyors has a resilient surface layer to which the path is tangential. A carrier is trained over two pulley assemblies of which one is separated from the roller by the path of the blank, and the carrier is guided by the second pulley assembly so that a portion of the carrier is spacedly parallel to the common plane. Ejectors on the carrier project into the path of the blank, displace adhering scrap and remain in the opening of the blank thus formed until the scrap is securely separated from the blank.

8 Claims, 4 Drawing Figures

APPARATUS FOR TRIMMING ADHERING SCRAP FROM A PUNCHED CARDBOARD BLANK

This invention relates to apparatus for trimming adhering scrap from a punched cardboard blank, and particularly to an improvement of the trimming apparatus disclosed in my earlier Japanese Pat. Nos. 579,110 and 702,846.

In the earlier patents, there was disclosed apparatus in which a punched cardboard blank is discharged from the punching apparatus into a space between two rollers rotating about parallel axes and spaced to pass the blank therebetween. Ejectors on one roller project into the path of the blank to displace adhering scrap. The known devices are in successful use on an industrial scale, but difficulties are sometimes encountered with pieces of scrap which are elongated in the direction of blank movement. After the leading end of the scrap piece is dislodged by an ejector, it may return to its initial position after passsing the narrow, almost linear ejection zone between the two rollers before the trailing end is dislodged by another ejector, and the piece of scrap may be carried to the next operation in a continuous blank processing line and cause malfunctioning.

It is a primary object of this invention to modify the known apparatus in such a manner that the malfunctioning described above is safely prevented.

With this and other objects in view, the invention provides scrap trimming apparatus including two conveyors having respective driven surface portions which define successive parts of a path of travel for a punched blank and are spaced from each other in the direction of travel. A roller mounted between the conveyors has a resilient surface layer to which the path of the blank is substantially tangential. A first pulley is separated from the roller by the path of the blank. A second pulley is offset from the first pulley in the direction of blank travel. A carrier trained over the two pulleys in a closed loop bounds the path in a direction transversely away from one of the conveyor surface portions. Ejector members are mounted on the carrier and project into the path of the blank to displace adhering scrap when the conveyors, the roller, and one of the pulleys are driven by a common drive for simultaneously moving the surface portions of the conveyors, the surface layer of the roller, and the carrier at the same speed in the same direction along the path of the blank to be trimmed.

Other features, additional objects, and many of the attendant advantages of this invention will readily be appreciated as the same becomes better understood by reference to the following detailed description of a preferred embodiment when considered in connection with the appended drawing in which:

FIG. 1 shows as much of a scrap trimming apparatus of the invention as is needed for an understanding of the invention, the omitted portion of the apparatus consisting mainly of supporting structure and the common drive for the illustrated components.

Figure 1:
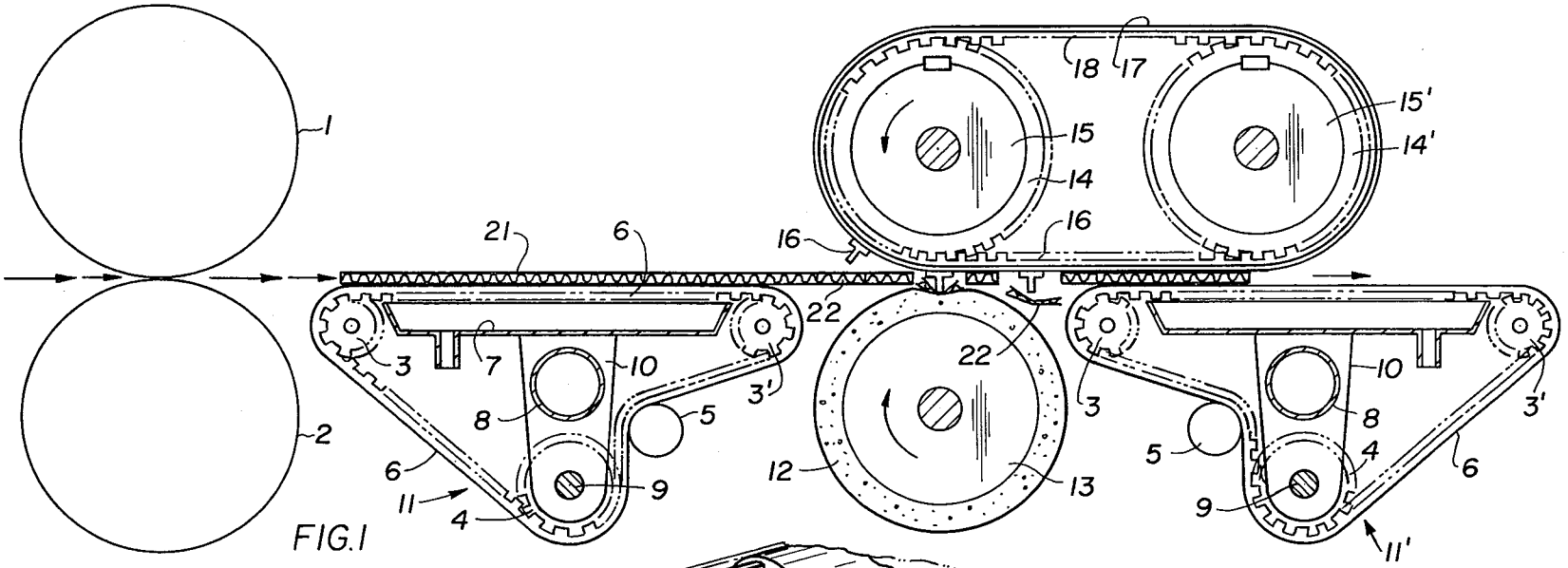
FIG. 1 illustrates trimming apparatus of this invention in fragmentary, side-elevational section.

The trimming apparatus is juxtaposed to a rotary blank punching machine whose rollers are represented conventionally by two circles 1, 2 only since they are known in themselves and not directly relevant to this invention. Steel ruler dies on the rollers 1, 2 cut openings and recesses in initially rectangular sheets of cardboard, but the scrap severed by the dies remains in position as the punched blank is discharged from the nip of the rollers 1, 2.

The apparatus of the invention includes two identical conveyors 11, 11'. A pair of brackets 10 is mounted in each conveyor on a horizontal tube 8 which is an element of the supporting structure, not shown otherwise in FIG. 1. Each bracket 10 is longitudinally adjustable on the supporting tube 8 and carries two idler sprockets 3, 3' and a tensioning pulley 5. A drive sprocket 4 is mounted on a drive shaft 9 common to both brackets and journaled in the non-illustrated supporting structure. A timing belt 6 is trained over each set of sprockets 3, 3', 4 and the associated tensioning pulley 5. The surface portions of the belts 6 between the idler pulleys 3, 3' define the straight horizontal path of a corrugated cardboard blank 21 discharged from the punching rollers 1, 2. A suction box 7 arranged between each pair of idler sprockets 3, 3' holds the blank 21 to the belts 6.

The two conveyors 11, 11' are spaced apart in the direction of blank travel so as to provide space for a roller 13 whose trunnions are journaled in the supporting structure, and whose metal core is covered with a heavy sleeve 12 of soft rubber. The path of the cardboard blank 21 is tangential to the surface of the rubber sleeve 12.

The axis of rotation of the roller 13 is located in a common plane perpendicular to the path of cardboard travel with the axis of rotation of a first pulley assembly whose drive shaft 15 is provided with a tubular sprocket 14 keyed to the shaft 15 for joint rotation. As will presently be described in more detail, timing belts 18 conformingly engage the teeth or axially elongated ribs uniformly distributed over the circumference of the sprocket 14. The belts 18 are also trained over a second pulley assembly almost identical with the first assembly and essentially consisting of a tubular sprocket 14' keyed to an idler shaft 15'. A sheet 17 studded with ejectors 16 is adhesively fastened to each belt 18.

Figure 4:
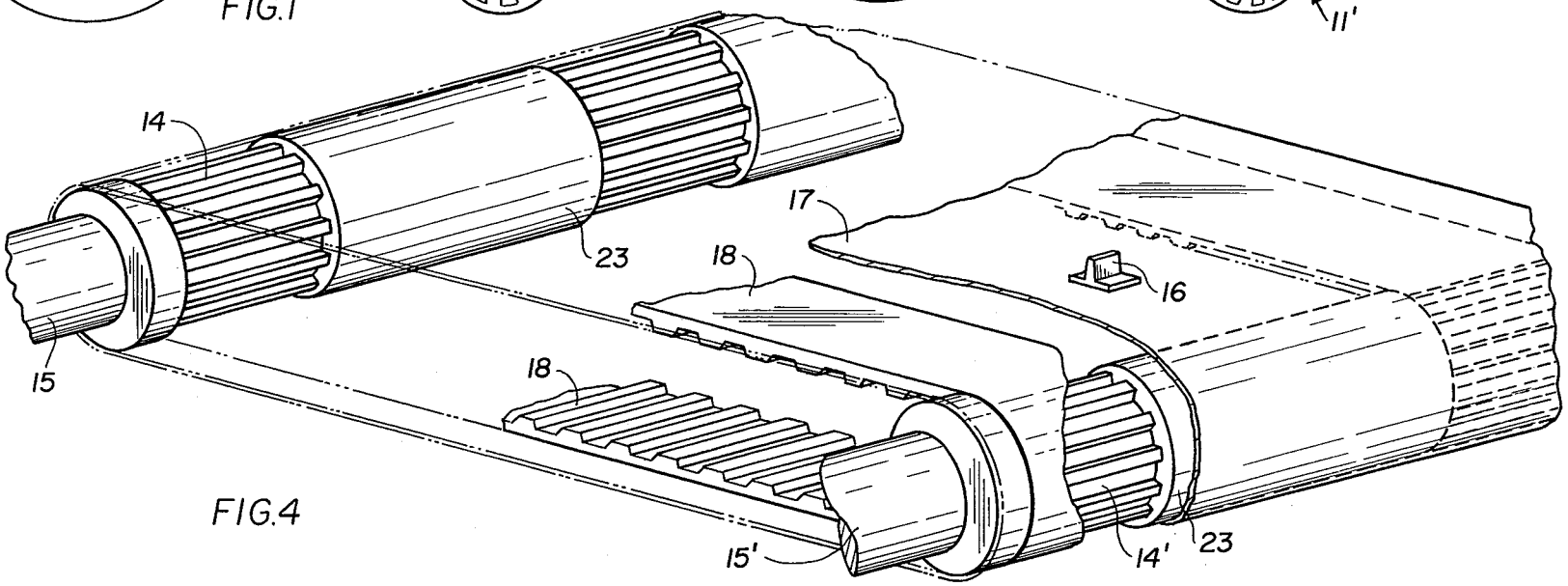
FIG. 4 illustrates elements of the device of FIG. 2 in a perspective, partly sectional view.
Figure 2:
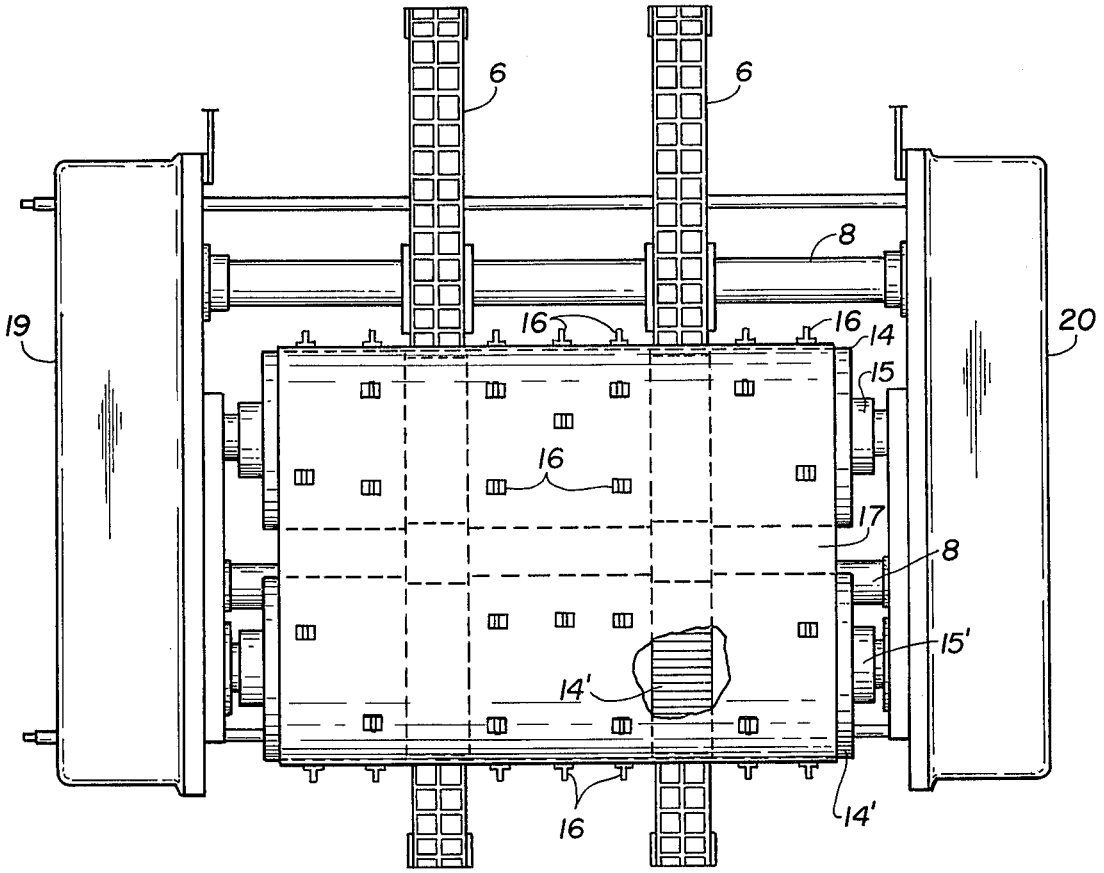
FIG. 2 is a top plan view of portions of the apparatus of FIG. 1.
Figure 3:
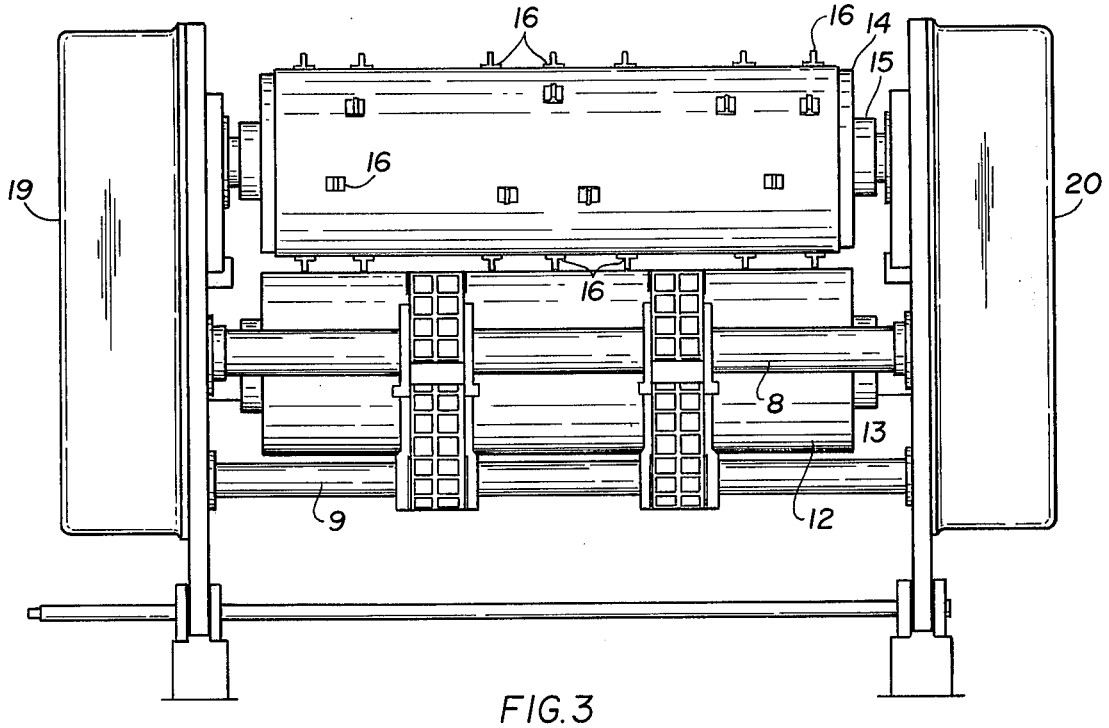
FIG. 3 shows the device of FIG. 2 in front elevation.

In FIGS. 3, 4, and 2, portions of the trimming apparatus are shown in more detail, but only portions of the belts 6 and the tubes 8 represent the conveyors 11, 11'. As is best seen in FIG. 4, spacer sleeves 23 cover radially aligned, axial sections of the sprockets 14, 14' to which they are secured by the teeth or ribs of the sprockets being conformingly received in internal grooves of the spacer sleeves 23. The scrap ejectors 16 are longitudinal portions of an aluminum rail of T-shaped sections whose flange is adhesively fastened to the sheet 17 which itself is fastened to belts 18 trained over the portions of the sprockets 14, 14' exposed between spacer sleeves 23.

As is seen in FIGS. 2 and 3, the supporting structure of the trimming apparatus includes two connected housings 19, 20 in which the shafts 9, 15, 15' and the roller 13 are journaled and the tubes 8 are fixedly fastened. The housing obscures the gearing which connects the shafts 9, 15 to the roller 13 and to an electric motor, not visible, which drives the several rotatable elements in such a manner that the belts 6, the resilient surface of the roller 13, and the scrap ejectors 16 travel at a precisely uniform speed along or in the path of the blank 21.

As is shown in FIG. 1, the ejectors engage pieces of scrap 22 and depress them out of the useful portion of the blank 21 into the soft rubber sleeve 12 as the scrap pieces pass between the first pulley assembly 14, 15 and the roller 12. The ejectors 16 remain in the opening so formed in the blank 21 while the blank travels between the parallel surfaces of the horizontal runs of the belts 6 of the conveyor 11' and the sheet 17. The ejectors 16 are not withdrawn from the blank 21 until the sheet 17 travels arcuately upward around the second or idler pulley 14', 15' with the belts 18. The dislodged scrap pieces are dropped through the gap between the roller 13 and the conveyor 11' and cannot reach a later operation, not shown.

As is best seen in FIGS. 2 and 3, the ejectors 16 are mounted on the portions of the sheet 17 which travel in a closed loop over the hard spacer sleeves 23 while the portions of the sheet 17 overlying the soft and apertured belts 18 are bare of scrap ejectors 16 to avoid incomplete ejection of scrap pieces. The ejectors 16 are backed by the sleeves 23 on the shaft 15 when aligned with the roller 13. The spacer sleeves 23 and the belts 18 are shifted on the sprockets 14, 14' to provide available locations for the ejectors 16 to match the pattern of cuts and scrap pieces on the punched blank.

While the scrap trimming apparatus of the invention has been described with reference to the trimming of corrugated cardboard blanks, it may be used without change on other sheet material, such as paperboard, but also on punched blanks of sheet aluminum, plastic, and other materials in which the complete removal of punched scrap is encountered.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. Apparatus for trimming adhering scrap from a punched cardboard blank comprising:

a. two conveyors having respective driven surface portions defining successive parts of a path of travel for said punched blank and spaced from each other in the direction of said travel;

b. a roller mounted between said conveyors for rotation about an axis and having a resilient surface layer, said path being substantially tangential to said layer;

c. a first pulley separated from said roller by said path;

d. a second pulley offset from said first pulley in said direction along said path, said pulleys being mounted for rotation about respective axes;

e. a carrier trained over said pulleys in a closed loop and bounding said path in a direction transversely away from one of said surface portions;

f. a plurality of ejector members mounted on said carrier projecting therefrom into said path; and g. drive means operatively connected to said conveyors, said roller, and one of said pulleys for simultaneously moving said surface portions, said surface layer, and said carrier at the same speed in the same direction along said path.

2. Apparatus as set forth in claim 1, wherein said surface portions are planar and aligned substantially in a common plane tangential to said roller and spacedly parallel to a portion of said carrier extending between said pulleys and bounding said path.

3. Apparatus as set forth in claim 2, wherein said roller and said one surface portion define therebetween a gap sufficient to receive scrap ejected from said path by said ejector members.

4. Apparatus as set forth in claim 1, wherein the portion of said loop bounding said path and said one surface portion are substantially parallel.

5. Apparatus as set forth in claim 4, wherein said portion of said loop is planar.

6. Apparatus as set forth in claim 1, wherein said first pulley includes a shaft, a plurality of axially elongated ribs circumferentially uniformly spaced about the axis of said pulley on said shaft, said carrier being formed with recesses therein conformingly receiving said ribs during rotation of said pulley.

7. Apparatus as set forth in claim 6, wherein said first pulley further includes a sleeve centered in said axis, said sleeve being internally grooved and conformingly receiving respective axially central portions of said ribs, said carrier including two belt members axially separated by said sleeve and a sheet member fastened to said belt members and trained over said sleeve, said ejector members being fastened to said sheet member and axially offset from said sleeve.

8. Apparatus as set forth in claim 7, wherein said ejector members are radially aligned with said sleeve member.

* * * * *